US008931970B1

(12) United States Patent
Mays et al.

(10) Patent No.: US 8,931,970 B1
(45) Date of Patent: Jan. 13, 2015

(54) TICKET PRINTER

(71) Applicant: Pyramid Group, Inc., Mesa, AZ (US)

(72) Inventors: David S. Mays, Mesa, AZ (US); Leif J. Strom, Phoenix, AZ (US)

(73) Assignee: Pyramid Group, Inc., Mesa, AZ (US)

( * ) Notice: Subject to any disclaimer, the term of this patent is extended or adjusted under 35 U.S.C. 154(b) by 81 days.

(21) Appl. No.: 13/755,193

(22) Filed: Jan. 31, 2013

Related U.S. Application Data

(60) Provisional application No. 61/596,598, filed on Feb. 8, 2012, provisional application No. 61/645,165, filed on May 10, 2012, provisional application No. 61/645,219, filed on May 10, 2012, provisional application No. 61/645,209, filed on May 10, 2012.

(51) Int. Cl.
*B41J 15/00* (2006.01)
*B65H 16/00* (2006.01)
*B65H 23/00* (2006.01)

(52) U.S. Cl.
CPC ..... *B65H 16/005* (2013.01); *B65H 23/00* (2013.01)
USPC ..... 400/613; 400/611

(58) Field of Classification Search
USPC ..... 400/613
See application file for complete search history.

(56) References Cited

U.S. PATENT DOCUMENTS

| | | | | |
|---|---|---|---|---|
| 5,719,611 | A * | 2/1998 | Nakamura et al. | 347/103 |
| 5,842,799 | A * | 12/1998 | Yamamoto et al. | 400/645.4 |
| 6,616,009 | B2 | 9/2003 | Yang | |
| 6,648,325 | B1 | 11/2003 | Mays et al. | |
| 6,715,948 | B2 * | 4/2004 | Morita et al. | 400/621 |
| 6,719,167 | B2 | 4/2004 | Chang | |
| 6,752,289 | B1 | 6/2004 | Lin | |
| 7,322,760 | B2 | 1/2008 | Campanini | |
| 7,553,098 | B2 * | 6/2009 | Maekawa et al. | 400/613 |
| 8,240,573 | B2 * | 8/2012 | Cardozo Martinez | 235/483 |
| 8,240,928 | B2 * | 8/2012 | Tsugaru et al. | 400/583 |
| 2006/0008311 | A1 * | 1/2006 | Miyasaka et al. | 400/613 |
| 2006/0165467 | A1 * | 7/2006 | Kawakami et al. | 400/613 |
| 2008/0310903 | A1 * | 12/2008 | Kohyama | 400/613 |

* cited by examiner

*Primary Examiner* — Anthony Nguyen
(74) *Attorney, Agent, or Firm* — Schmeiser, Olsen & Watts LLP; Lowell W. Gresham

(57) ABSTRACT

A ticket printer includes a housing having a frame and a front panel concurrently formed as a single unit. A printer unit is positioned in the housing and includes a print body and swing assembly having a print roller head. The swing assembly can be selectively rotated away from the print body for maintenance and cleaning. A paper guide, located at an outlet side of the printer unit, is positioned within the housing. Paper is routed between the print roller head and the print body of the printer unit. The paper guide directs the paper along a paper pathway and out of a ticket outlet in the front panel. The paper guide may be transparent to visualize jammed paper in the paper pathway. Paper directing ramps formed in the swing assembly and the paper guide direct the paper into the paper pathway and downwardly to the ticket outlet.

15 Claims, 6 Drawing Sheets

22

TICKET PRINTER

TECHNICAL FIELD OF THE INVENTION

The present invention relates generally to ticket printers. More specifically, the present invention relates to a ticket printer that is robust, serviceable, and resistant to paper jams.

BACKGROUND OF THE INVENTION

A ticket machine, also known as a ticket vending machine, is a vending machine that distributes tickets or coupons for a wide range of applications in the amusement, gaming, lottery, kiosk, and vending markets. A ticket vending machine typically includes a thermal ticket printer that prints and dispenses a ticket, coupon, or memorandum, to the user.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION

A ticket vending machine, kiosk, and the like is generally provided with a ticket printer unit that prints onto paper from a paper roll, cuts the paper into a ticket or coupon, and dispenses the ticket or coupon to a user. Accordingly, a ticket printer and cutting mechanism can be presented in series with one another. The paper upon which the ticket is printed is generally dispensed from a paper roll that is moved by rollers conventionally driven by electric motors or other suitable means toward the ticket outlet.

It is critical to the appropriate performance of the ticket printer unit, especially in self-serve scenarios, that the ticket not be mutilated or destroyed during the printing or dispensing operations. Furthermore, such ticket printer units should operate reliably with limited to no jamming of the paper along the paper pathway. Typically, however, the conventional design of the ticket printer does not readily allow the user to remove paper jams, easily clean the print head, or otherwise service the unit.

Embodiments entail a ticket printer having structural features combined with a relatively long paper pathway that function cooperatively to limit the potential for paper jams, thereby enhancing its reliability. Additionally, the structural features of the ticket printer facilitate straightforward paper loading, removable of jammed paper or paper residue, maintenance and cleaning, and so forth. Furthermore, the structural features enable a compact and cost effective design that is useful in a variety of configurations and in environments where space is limited.

Figure 1:
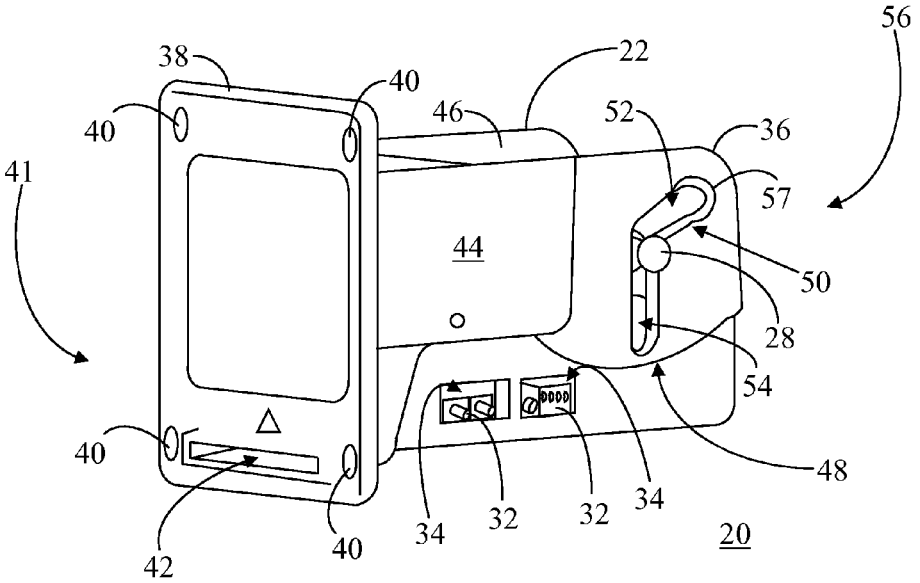
FIG. 1 shows a front perspective view of a ticket printer in accordance with an embodiment.
Figure 2:
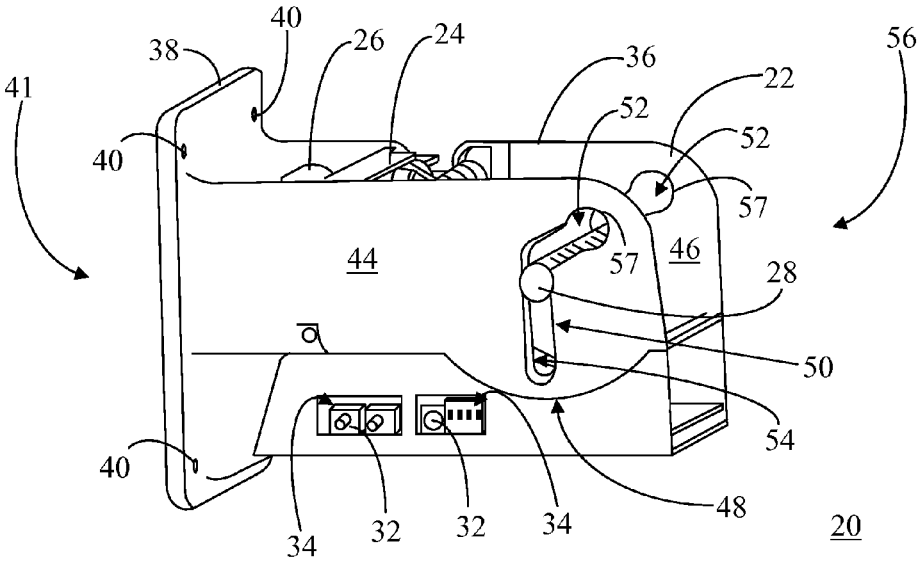
FIG. 2 shows side perspective view of the ticket printer.

Referring to FIGS. 1 and 2, FIG. 1 shows a front perspective view of a ticket printer 20 in accordance with an embodiment and FIG. 2 shows side perspective view of ticket printer 20. Ticket printer 20 generally includes a housing 22. A printer unit 24, at least one paper guide 26, and a rod 28 for a paper roll 30 (FIG. 9) are positioned within housing 22. Ticket printer 20 can include additional elements such as a printed circuit board having electronic controls 32 that may be located within a recess 34 of housing 22. Electronic controls 32 manage the operation of ticket printer 20 and may be fixed or user-configurable.

Housing 22 includes a frame 36 and a front panel 38 fixed to frame 36. In an embodiment, frame 36 and front panel 38 are concurrently formed as a single unit. For example, frame 36 and front panel 38 may be concurrently machined from a nonmetallic or metallic material, formed using a plastic molding process, or fabricated using any other suitable technique. Thus, housing 22 represents a one piece printer housing with integrated frame 36 and front panel 38.

Front panel 38 is a generally rectangular feature mounted generally parallel to the panel of the vending machine, kiosk, or any suitable surface that calls for ticket printer 20. Mounting holes 40 and recesses allow mounting screws (not shown) to securely mount ticket printer 20 to a surface. Front panel 38 includes a ticket outlet 42. As will be discussed in greater detail below, printed material, e.g., a ticket or coupon, is guided out of ticket printer 20 through ticket outlet 42. Thus, front panel 38 is the front, visible element, i.e., an outlet side 41, of ticket printer 20 from which a user can retrieve printed material (not shown).

In lieu of, or in addition to, mounting holes 40, ticket printer 20 may be furnished with clamps (not shown) that can be used to mount ticket printer 20 behind a host machine's outer surface. In addition, ticket outlet 42 can be oriented differently than what is shown and/or can be different sizes or shapes depending upon particular design requirements. Front panel 38 may also include a label recess for placement of a front label, LED diagnostic lights, and so forth in accordance with particular design configurations.

Frame 36 is the primary structural support of the components of ticket printer 20. It is constructed to hold paper roll 30 (FIG. 9), printer unit 24, and paper guides 26. Frame 36 includes first and second lateral side walls 44 and 46, respectively, extending vertically. A semi-circular area 48 of frame 36 is configured to cradle paper roll 30. A generally vertically oriented groove 50 extends through each of first and second side walls 44 and 46. In an embodiment, each groove 50 includes a first groove section 52 and a second groove section 54 that is contiguous with first groove section 52. Second groove section 54 is approximately vertically oriented. However, first groove section 52 is slanted away from the vertical orientation of second groove section 54 toward a back side 56 of ticket printer 20.

Paper roll 30 is mounted on rod 28, and rod 28 extends through groove 50 in each of first and second side walls 44 and 46. It should be noted that a distal end 57 of first groove section 52 includes a slightly enlarged region designed to accommodate rod 28. In an embodiment, rod 28 can only fit through the larger diameter opening at distal end 57 of first groove section 52. Rod 28 with paper roll 30 will then slide along the angled first groove section 52 into the vertically oriented second groove section 54. Due to the presence of the angled first groove section 52, rod 28 is thus prevented from inadvertently sliding back into the larger diameter opening at distal end 57 of first groove section 52 regardless of the orientation of ticket printer 20. The illustrated embodiment includes a paper roll that fits within the cradle area of housing 22. In other embodiments, however, housing 22 may have different support structures for paper roll 30 to allow for jumbo size rolls of paper that would not normally fit in the paper cradle area of housing 22.

Figure 3:
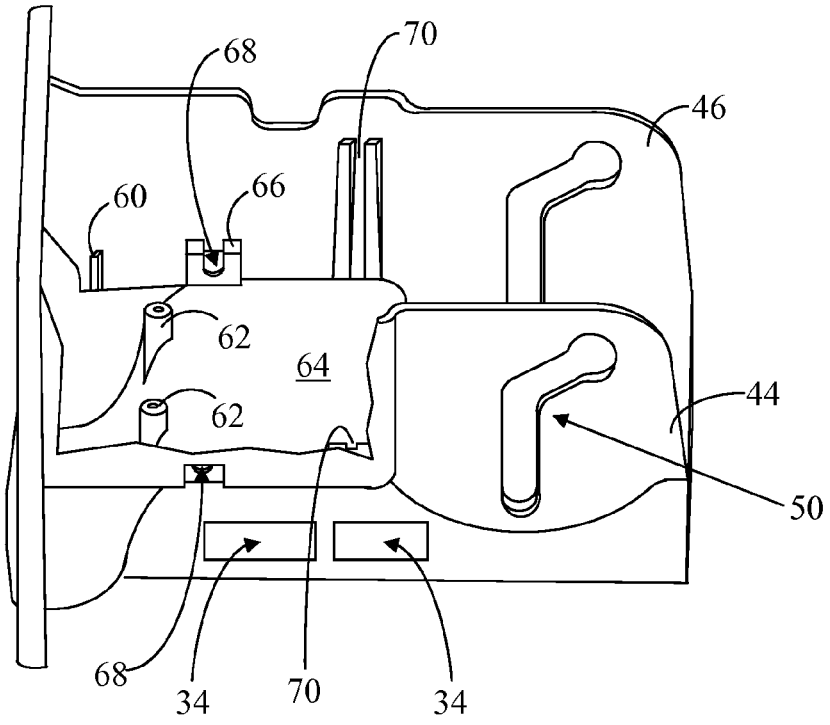
FIG. 3 shows a perspective view of a housing for the ticket printer.

FIG. 3 shows a perspective view of housing 22 for ticket printer 20 (FIG. 1). The components of ticket printer 20 positioned within housing 22 have been removed and a portion of first side wall 44 has been cut away in order to visualize the features that enable the retention of the various components of ticket printer 20 within housing 22. Housing 22 includes tab supports 60 (only one being visible) formed in each of first and second side walls 44 and 46, respectively, and used to retain one of paper guides 26 (FIG. 1). Lower guide supports 62 are formed in a base 64 of housing 22 and are used to retain another paper guide (discussed below).

Housing 22 further includes swing arm locators 66 (only one being fully visible) formed in first and second side walls 44 and 46, respectively. Each of swing arm locators 66 includes an aperture 68 extending through its respective side wall 44 and 46. A portion of printer unit 24 is coupled to housing 22 via apertures 68, as will be discussed below. Printer locating slots 70 (only one being fully visible) are also formed in first and second side walls 44 and 46. Another portion of printer unit 24 (discussed below) is coupled to housing 22 via printer locating slots 70.

Figure 4:
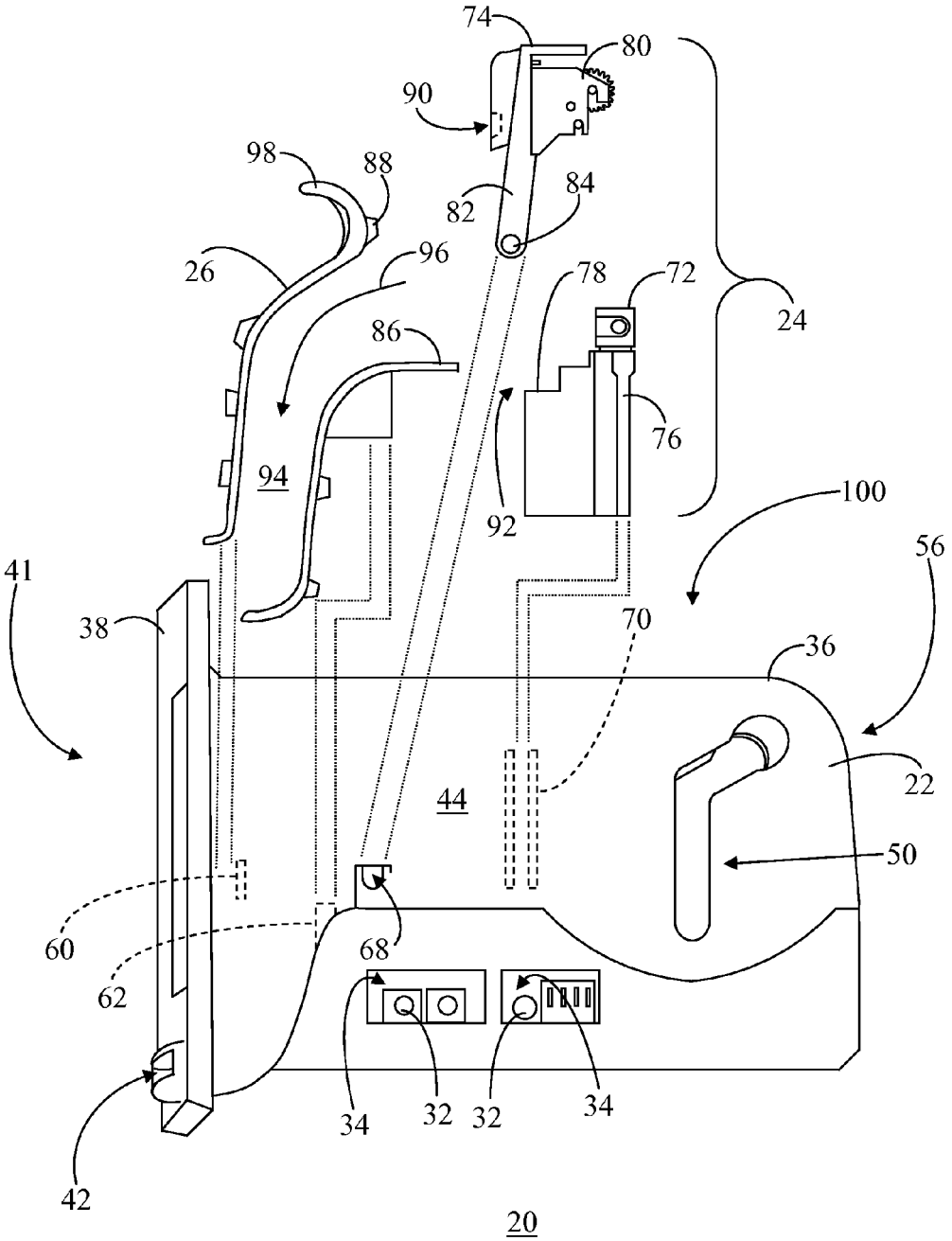
FIG. 4 shows an exploded side view of the ticket printer.

FIG. 4 shows an exploded side view of ticket printer 20. The side view image of housing 22 includes tab supports 60, lower guide supports 62, and printer locating slots 70. However, since elements 60, 62, and 70 are formed on the interior of housing 22, they would not actually be visible in this side view illustration. As such, tab supports 60, lower guide supports 62, and printer locating slots 70 are shown in dashed line form in order to visualize an attachment of components positioned within housing 22. Apertures 68 (one visible) of swing arm locators 66 (FIG. 3) extend through housing 22 and are thus shown in solid line form in FIG. 4.

As mentioned briefly above, ticket printer 20 includes printer unit 24. In a particular embodiment, printer unit 24 includes a print body 72 and a swing assembly 74. Print body 72 includes outwardly protruding elongated tabs 76 that are slid into printer locator slots 70 within housing 22 in order to hold print body 72 in the proper location. Additionally, screws, clips, and other such fasteners may optionally be implemented to further secure print body 72 in position within housing 22. In general, print body 72 includes a convention thermal printing unit that prints onto paper from paper roll 30 (FIG. 9) as the paper passes over a printing surface 78, i.e., a thermal plate, of print body 72.

Swing assembly 74 includes a print roller head 80 coupled to a swing arm structure 82. Posts 84 extend outwardly from opposing sides of swing arm structure 82, and are adapted to fit into apertures 68 within housing 22. Posts 84 are able to pivot within apertures 68 so that swing assembly 74, including print roller head 80, is selectively movable relative to print body 72. In an embodiment, a locking mechanism (discussed in connection with FIG. 9) typically retains swing assembly 74 in a fixed relationship with print body 72. When the lock mechanism is released, however, swing assembly 74 pivots away from print body 72 to expose printing surface 78.

As mentioned briefly above, ticket printer 20 includes at least one paper guide 26. In a particular embodiment, this first paper guide 26 is referred to hereinafter as an upper paper guide 26. Ticket printer 20 further includes a second paper guide, referred to herein as a lower paper guide 86. Lower paper guide 86 is seated on and fastened to lower guide supports 62 within housing 22. Upper paper guide 26 interfaces with tab supports 60 to retain guide 26 in housing 22. In addition, upper paper guide 26 includes an outwardly extending tab 88 that seats in a recess 90 formed in swing assembly 74. Tab 88 creates in interference fit with swing assembly 74 (and consequently the attached print roller head 80) to securely retain upper paper guide 26 in housing 22.

Lower paper guide 86 and upper paper guide 26 are secured in housing 22 proximate a printer outlet 92 of print body 72 of printer unit 24. And, guides 86 and 26 extend from printer outlet 92 to ticket outlet 42 in front panel 38. A space 94 between lower and upper paper guides 86 and 26 forms a paper pathway, represented by an arrow 96, along which paper from paper roll 30 (FIG. 9) is directed. The paper subsequently exits out of ticket outlet 42 in front panel 38.

Upper paper guide 86 further includes a pull handle 98 accessible from an upper side 100 of housing 22. A user can grasp pull handle 98 and apply a pulling force in order to break the interference fit between tab 88 and recess 90 in swing assembly 74. The user can thus remove upper paper guide 86 from housing 22. Accordingly, in the instance that paper is jammed in paper pathway 96, the paper can be readily taken out.

Figure 5:
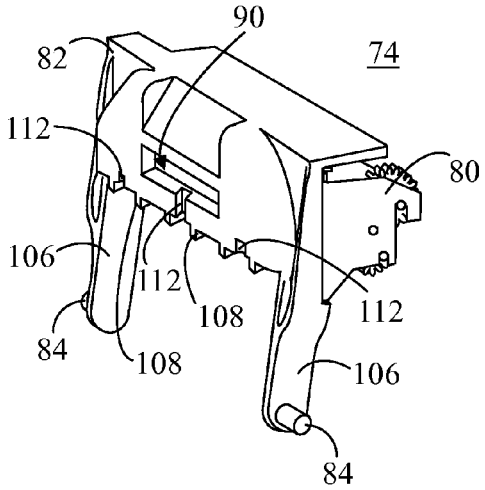
FIG. 5 shows a front perspective view of a swing assembly for the ticket printer.
Figure 6:
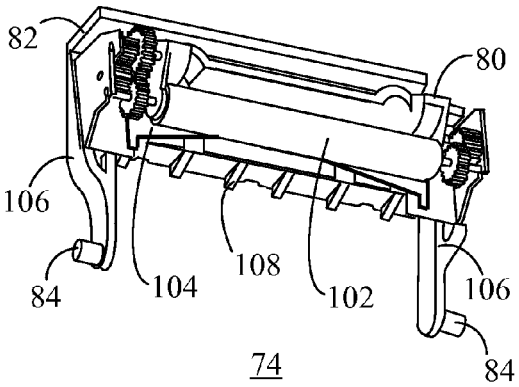
FIG. 6 shows a rear perspective view of the swing assembly.
Figure 7:
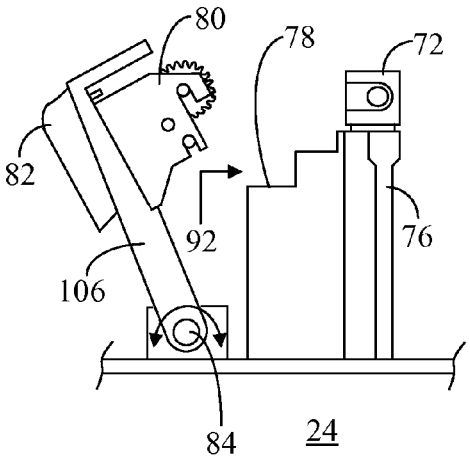
FIG. 7 shows a side view of printer unit for the ticket printer.

Referring now to FIGS. 5-7, FIG. 5 shows a front perspective view of swing assembly 74 for ticket printer 20 (FIG. 1). FIG. 6 shows a rear perspective view of swing assembly 74, and FIG. 7 shows a side view of printer unit 24 for ticket printer 20. Swing assembly 74 includes swing arm structure 82 to which print roller head 80 is coupled via screws or positive engagement features. Print roller head 80 includes a paper roller 102 that feeds paper from paper roll 30 (FIG. 9) over printing surface 78 (FIG. 4) of print body 72 and out of printer unit 24 (FIG. 4). Print roller head 80 further includes a cutting blade 104 located proximate printer outlet 92. Cutting blade 104 moves down to cut paper and retracts upward out of the path of the next ticket being printed.

Swing arm structure 82 includes a pair of arms 106, each having posts 84 extending from an end thereof. As discussed above, posts 84 are adapted to reside in apertures 68 (FIG. 4) of housing 22 (FIG. 4). Thus, swing arm structure 82 can freely rotate when released from print body 72 of printer unit 24, as demonstrated in FIG. 7. Although swing arm structure 82 is shown having outwardly extending posts 84, in an alternative embodiment, swing arm structure 82 could be attached to frame 36 (FIG. 1) of housing 22 (FIG. 1) using screws or other such fasteners that are secured through housing 22 and into arms 106 of swing arm structure 82. In yet another embodiment, posts could be formed in housing 22, and swing arm structure 82 could be coupled to the posts by sliding arms 106 with through holes over the molded posts.

Swing arm structure 82 further includes paper directing ramps 108 formed therein. Paper directing ramps 108 function cooperatively with paper directing ramps formed in upper paper guide 26 to direct paper from paper roll 30 (FIG.

9) toward ticket outlet 42 (FIG. 1). Ramps 108 will be discussed in greater detail in connection with FIG. 11.

Figure 8:
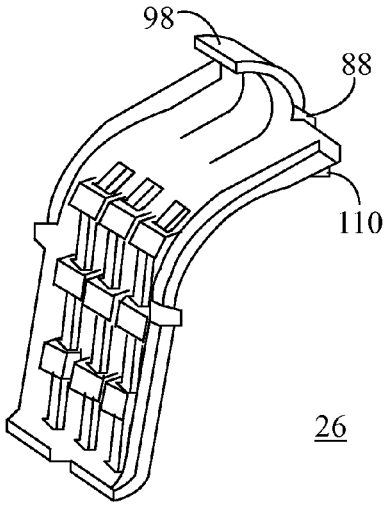
FIG. 8 shows a front perspective view of a paper guide for the ticket printer.

FIG. 8 shows a front perspective view of upper paper guide 26 for ticket printer 20 (FIG. 1). Upper paper guide 26 includes tab 88 extending from an upper edge thereof for engagement with recess 90 (visible in FIG. 5) in swing arm structure 82, and pull handle 98 at which a user can pull up to remove upper paper guide 26. Upper paper guide 26 further includes paper directing ramps 110 that function cooperatively with paper directing ramps 108 (FIG. 5) in swing arm structure 82. Paper directing ramps 110 can reside in recesses 112 (see FIG. 5) formed in swing arm structure 82, and will thus overlie paper directing ramps 108, so that paper direct ramps 108 extend below paper directing ramps 110. Paper directing ramps 110 in upper paper guide 26 overlie paper directing ramps 108 in swing arm structure 82 to create an edgeless transition between swing arm structure 82 and upper paper guide 26. Again, ramps 108 and ramps 110 will be discussed in greater detail in connection with FIG. 11.

In an embodiment, upper paper guide 26, and optionally, lower paper guide 86 (FIG. 4) is transparent or reasonably see-through. For example, upper paper guide 26 may be a machined or molded element formed from a clear plastic to that it is transparent following fabrication. Alternatively, at least a portion of upper paper guide 26 may be transparent thus forming a viewing window. A transparent upper paper guide 26, or viewing window, allows a user to determine whether there is an obstruction in paper pathway 96 (FIG. 4) without disassembling ticket printer 20 (FIG. 1). Therefore, the transparent upper paper guide 26 provides for ready paper jam identification inside the paper path of ticket printer 20.

Figure 9:
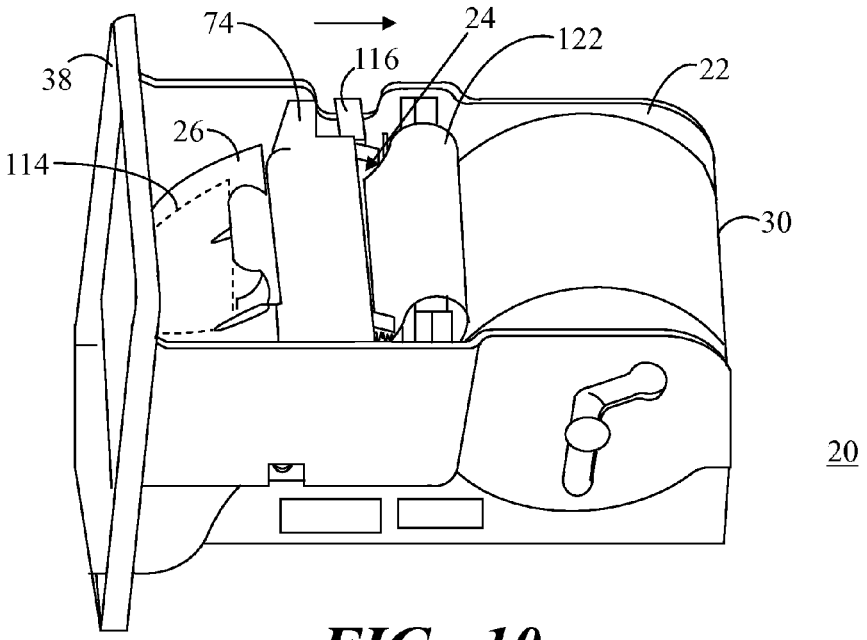
FIG. 9 shows a top perspective view of the ticket printer with a paper roll loaded therein.
Figure 10:
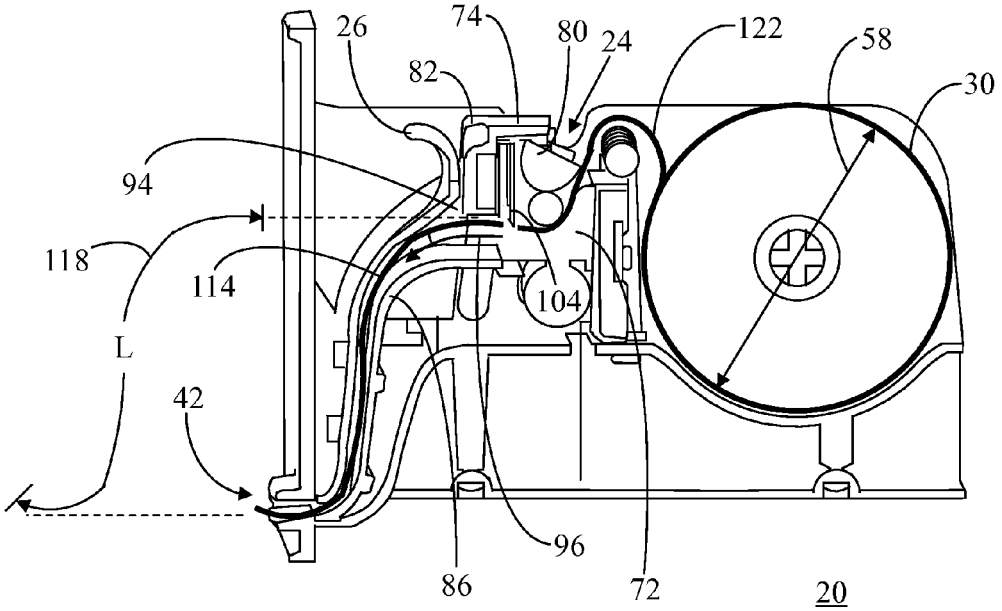
FIG. 10 shows a side sectional view of the ticket printer with the paper roll loaded therein.

Referring to FIGS. 9 and 10, FIG. 9 shows a top perspective view of ticket printer 20 with paper roll 30 loaded therein and FIG. 10 shows a side sectional view of ticket printer 20 with paper roll 30 loaded therein. FIGS. 9 and 10 are provided to generally demonstrate the printing of paper from paper roll 30 in printer unit 24 and the paper being cut by cutting blade 104 so that a printed ticket 114 travels along paper pathway 96 in space 94 between upper paper guide 26 and lower paper guide 86 to ticket outlet 42.

To install paper from paper roll 30 into ticket printer 20, upper paper guide 26 is removed from ticket printer 20. Next, a locking mechanism 116 is slid toward the rear of ticket printer 20. Locking mechanism 116 couples swing assembly 74, including printer roller head 80, to print body 72 for normal operation. Locking mechanism 116 can be released to enable swing assembly 74 to pivot and move forward, as illustrated in FIG. 7. Paper is inserted between swing assembly 74 and print body 72. Following insertion of the paper, swing assembly 74 is closed until it locks in place with locking mechanism 116. Next, upper paper guide 26 is re-installed in ticket printer 20.

A similar process may be implemented to clear a paper jam in ticket printer 20 and/or clean printer unit 24 and paper pathway 96. It should be noted that ticket 114 is presented in dashed line form in FIG. 9. Since at least a portion of upper paper guide 26 is transparent, ticket 114 can be seen as it travels along paper pathway 96. Thus, if ticket 114 is jammed in paper pathway 96, it can be visualized and the problem can be readily resolved by removing paper guide 26 and removing ticket 114 from paper pathway 96 and/or by releasing locking mechanism 116 and removing the jammed paper from between print roller head 80 and print body 72.

In an embodiment, upper paper guide 26 uses positive engagement snaps to fit against swing assembly 74. A user can pull up to remove upper paper guide 26 and simply align and push down to install upper paper guide 26. Swing assembly 74 thus applies pressure to upper paper guide 26 to hold guide 26 firmly in place. In an alternative embodiment, upper paper guide 26 may be attached to housing 36 using screws or some other fastening means. The screws or other fastening means would thus have to be removed to enable the removal of upper paper guide 26. Alternatively, upper paper guide 26 could be hinged to allow access to paper pathway 96, instead of making paper guide 26 removable.

After the paper is loaded, ticket printer 20 receives communication from the host machine (not shown) to which it is connected, and transfers the communication into an image or text to be printed by printer unit 24. Printer unit 24 prints the communication onto paper 122 from paper roll 30, and feeds the printed ticket 114 out of printer unit 24 and along paper pathway 96 in space 94. Cutting blade 104 is located proximate outlet side 92 (FIG. 7) of printer unit 24. After paper 122 is cut to produce ticket 114, a length of ticket 114 is approximately equivalent to a length 118 of paper pathway 96. Thus, after it is printed and cut, ticket 114 is directed downwardly through paper pathway 96 so that only a small portion of ticket 114 eventually extends out of ticket outlet 42. Since ticket 114 is already cut before it extends significantly out of ticket outlet 42, the paper from paper roll 30 cannot be a pulled by a user at ticket outlet 42. This feature reduces the potential for jamming due to pulling, twisting, or dragging of the paper.

Figure 11:
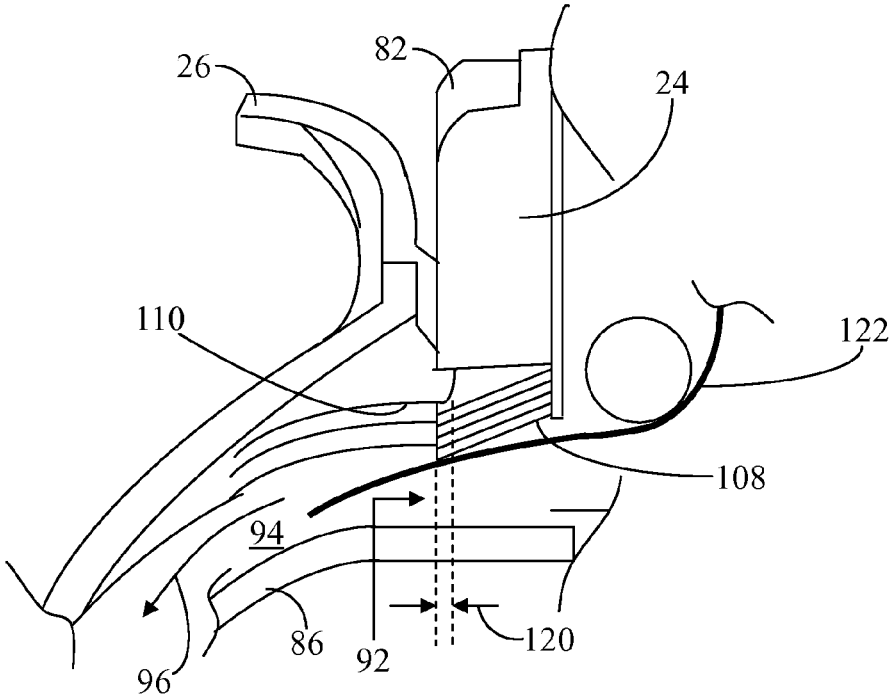
FIG. 11 shows an enlarged side view of a portion of the ticket printer.

FIG. 11 shows an enlarged side view of a portion of ticket printer 20. In particular, FIG. 11 shows the interface between upper paper guide 26 and swing arm structure 82 of printer unit 24. In general, paper directing ramps 108 on swing arm structure 82 are positioned at printer outlet 92 of printer unit 24, and paper directing ramps 110 overlie, i.e., are positioned higher than, paper directing ramps 108. Additionally, paper directing ramps 110 overlap, i.e., paper directing ramps 108. That is, the edge of ramps 110 fits over the edge of ramps 108 as demonstrated by an overlap region 120 in FIG. 11. Furthermore, the paper directing ramps 110 are arranged in alternating fashion with paper directing ramps 108. Thus, the interface between printer unit 24 and upper paper guide 26 forms a substantially edgeless transition between printer outlet 92 of printer unit 24 and paper pathway 96.

In operation, paper directing ramps 108 built into swing arm structure 82 direct paper 122 from paper roll 30 (FIG. 9) in a downward direction. Ramps 110 on upper paper guide 26 direct paper 120 against its natural upwards curl so that it moves down toward ticket outlet 42 (FIG. 1). The edgeless transition and the downward direction minimizes the possibility of paper 122 becoming jammed between adjacent parts of ticket printer 20.

Figure 12:
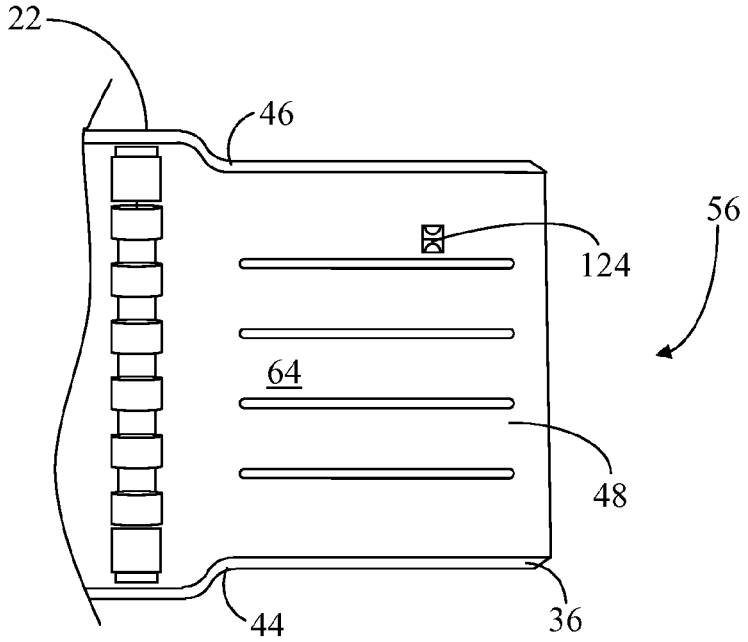
FIG. 12 shows an enlarged top view of a portion of the housing for the ticket printer with a paper sensor mounted therein.

FIG. 12 shows an enlarged top view of a portion of housing 22 for ticket printer 20 with a paper sensor 124 mounted therein. In particular, a portion of first and second side walls 44 and 46 and semi-circular area 48 of frame 36 is shown. FIG. 12 does not include paper roll 30 (FIG. 9) so that base 64 is visible. Paper sensor 124 may be mounted on base 64. In an embodiment, paper sensor 124 is a reflective paper sensor that is configured to detect the presence of paper roll 30. When diameter 58 (FIG. 10) of paper roll 30 is sufficiently reduced, reflective paper sensor 124 will no longer reflect off of the white paper roll 30. Reflective paper sensor 124 then signals the absence of paper 122 (FIG. 9) on paper roll 30 to an onboard processor (not shown) that paper roll 30 is small. Accordingly, a user can be signaled when it is time to replace paper roll 30.

In summary, embodiments entail a ticket printer having structural features combined with a relatively long paper pathway that function cooperatively to limit the potential for paper jams, thereby enhancing its reliability. These structural features includes a removable paper guide, a print roller head that swings away from a print body of a printer unit for removing jammed paper and/or for cleaning and maintenance. The removable paper guide may be transparent to better visualize jammed paper in a paper pathway. In addition, overlapping paper directing ramps located at an outlet side of the printer unit direct the paper through the paper pathway between the paper guides against the natural curl of the paper. The paper guides form a relatively long paper pathway so that very little of the ticket exits the ticket printer prior to printing and cutting of the ticket. In addition, the front panel and frame of the ticket printer may be formed as an integrated unit to minimize components and labor time for assembly. The structural features of the ticket printer facilitate straightforward paper loading, removable of jammed paper or paper residue, maintenance and cleaning, and so forth. Furthermore, the structural features enable a compact and cost effective design that is useful in a variety of configurations and in environments where space is limited.

Although the preferred embodiments of the invention have been illustrated and described in detail, it will be readily apparent to those skilled in the art that various modifications may be made therein without departing from the spirit of the invention or from the scope of the appended claims. That is, it should be appreciated that the exemplary embodiments are only examples, and are not intended to limit the scope, applicability, or configuration of the invention.

What is claimed is:

1. A ticket printer comprising:

a housing that includes a frame and a front panel fixed to said frame, said front panel having a ticket outlet, and said frame being configured to hold a paper roll;

a printer unit positioned within said housing and coupled with said frame, said printer unit including a print body and a print roller head that is selectively movable relative to said print body, said print roller head being rotated away from said print body to access said print body; and a paper guide removably positioned within said housing, said paper guide being located at an outlet side of said printer unit, wherein said paper is routed through said printer unit and output from said outlet side of said printer unit, said paper guide directs said paper along a paper pathway and out of said ticket outlet in said front panel, and at least a portion of said paper guide is transparent to enable a view of said paper in said paper pathway.

2. A ticket printer as claimed in claim 1 wherein said frame and said front panel are concurrently formed as a single unit.

3. A ticket printer as claimed in claim 1 wherein:

said frame includes first and second side walls, each of said first and second side walls having a generally vertically oriented groove extending through said each of said first and second side walls; and said ticket printer further comprises a rod extending through said groove in each of said first and second side walls, said paper roll being mounted on said rod.

4. A ticket printer as claimed in claim 3 wherein said groove includes a first groove section and a second groove section contiguous with said first groove section, said second groove section being approximately vertically oriented, and said first groove section being slanted away from said vertical orientation of said second groove section toward a back side of said frame.

5. A ticket printer as claimed in claim 1 further comprising a sensor mounted in said housing, said sensor being configured to determine an absence of said paper on said paper roll in response to a diameter of said paper roll.

6. A ticket printer as claimed in claim 1 further comprising:

a swing arm mechanism coupled to said print roller head, said swing arm mechanism being pivotally coupled to said housing at a pivot point; and a locking mechanism coupling said print roller head to said printer body, wherein said locking mechanism is released to enable said swing arm to pivot and thereby move said print roller head away from said print body.

7. A ticket printer as claimed in claim 1 wherein said paper guide includes an outwardly extending tab, said tab creating an interference fit with said print roller head to retain said paper guide in said housing.

8. A ticket printer comprising:

a housing that includes a frame and a front panel fixed to said frame, said front panel having a ticket outlet, and said frame being configured to hold a paper roll;

a printer unit positioned within said housing and coupled with said frame, said printer unit including a print body and a print roller head that is selectively movable relative to said print body, said print roller head being rotated away from said print body to access said print body; and a paper guide removably positioned within said housing, said paper guide being located at an outlet side of said printer unit, wherein said paper is routed through said printer unit and output from said outlet side of said printer unit, and said paper guide directs said paper along a paper pathway and out of said ticket outlet in said front panel, wherein said paper guide includes:

an outwardly extending tab, said tab creating an interference fit with said print roller head to retain said paper guide in said housing; and a pull handle accessible from an upper side of said housing, wherein force on said pull handle breaks said interference fit between said tab and said print roller head to enable removal of said paper guide from said housing.

9. A ticket printer as claimed in claim 1 wherein said paper guide is a first paper guide, and said ticket printer further comprises a second paper guide secured in said housing proximate said outlet side of said printer unit, and a space between said first and second paper guides forms said paper pathway along which said paper is directed.

10. A ticket printer as claimed in claim 9 further comprising a cutting blade located proximate said outlet side of said printer unit, said cutting blade being configured to cut said paper to a final paper length that is approximately equivalent to a length of said paper pathway length.

11. A ticket printer as claimed in claim 1 wherein said paper guide includes downwardly directed ramps located within said paper pathway configured to guide said paper downwardly through said paper pathway and toward said ticket outlet.

12. A ticket printer as claimed in claim 1 wherein:

said printer unit further comprises first paper directing ramps located at said outlet side of said printer unit; and said paper guide comprises second paper directing ramps configured to interface with said first paper directing ramps to guide said paper along said paper pathway, wherein said second paper directing ramps overlie said first paper directing ramps to form a substantially edgeless transition between said outlet side of said printer unit and said paper pathway.

13. A ticket printer comprising:

a housing that includes a frame and a front panel fixed to said frame, said front panel having a ticket outlet, and said frame being configured to hold a paper roll;

a printer unit positioned within said housing and coupled with said frame, said printer unit including a print body and a print roller head;

a swing arm mechanism coupled to said print roller head, said swing arm mechanism being pivotally coupled to said housing;

a locking mechanism coupling said print roller head to said printer unit, wherein said locking mechanism is released to enable said swing arm to pivot and thereby move said print roller head away from said print body; and a paper guide removably positioned within said housing, said paper guide being located at an outlet side of said printer unit, said paper guide including an outwardly extending tab, said tab creating an interference fit with said print roller head to retain said paper guide in said housing, and said paper guide further including a pull handle accessible from an upper side of said housing, and force on said pull handle breaks said interference fit between said tab and said print roller head to enable removal of said paper guide from said housing, wherein said paper is routed through said printer unit and output from said outlet side of said printer unit, and said paper guide directs said paper along a paper pathway and out of said ticket outlet in said front panel.

14. A ticket printer as claimed in claim 13 wherein said paper guide is a first paper guide, and said ticket printer further comprises:

a second paper guide secured in said housing proximate said outlet side of said printer unit, a space between said first and second paper guides forms said paper pathway along which said paper is directed, a length of said first and second paper guides defines a length of said paper pathway; and a cutting blade located proximate said outlet side of said printer unit, said cutting blade being configured to cut said paper to a final paper length that is approximately equivalent to said length of said paper pathway.

15. A ticket printer as claimed in claim 13 wherein at least a portion of said paper guide is transparent to enable a view of said paper in said paper pathway.

* * * * *